United States Patent [19]

Stromquist et al.

[11] 4,035,608

[45] July 12, 1977

[54] MULTI-PANE WINDOW STRUCTURE

[75] Inventors: Michael Eban Stromquist, Studio City; James Joseph Heaney, Glendale, both of Calif.

[73] Assignee: Anthony's Manufacturing Company, Inc., San Fernando, Calif.

[21] Appl. No.: 632,365

[22] Filed: Nov. 17, 1975

[51] Int. Cl.[2] ..... H05B 1/00

[52] U.S. Cl. ..... 219/218; 52/171; 62/248; 219/213; 219/214

[58] Field of Search ..... 219/213, 214, 218, 522; 52/171; 62/150, 148, 248, 275

[56] References Cited

U.S. PATENT DOCUMENTS

| | | | |
|---|---|---|---|
| 2,497,507 | 2/1950 | McMaster | 219/522 |
| 2,557,905 | 6/1951 | Burton et al. | 219/522 X |
| 3,192,575 | 7/1965 | Rosenau, Jr. et al. | 219/522 UX |
| 3,263,063 | 7/1966 | Marriott et al. | 219/218 X |

*Primary Examiner*—C. L. Albritton

*Attorney, Agent, or Firm*—Kleinberg, Morganstern, Scholnick & Mann

[57] ABSTRACT

In a multi-pane window structure for use between a cold region and a warmer region, where the first pane adjoining the warmer region is electrically heated to prevent condensation or frost, the improvement comprising an infrared-reflective coating transparent to visible light applied to the second pane from the warmer area on the surface thereof facing the warmer region.

9 Claims, 2 Drawing Figures

MULTI-PANE WINDOW STRUCTURE

BACKGROUND OF THE INVENTION

1. Field of the Invention

The present invention is in the field of window structures and more particularly, multi-pane insulative window structure, having an electrically heated pane.

2. Description of the Prior Art

It has long been known that an insulative window structure can be formed by mounting two or more panes of transparent material in a spaced-apart relationship so that an insulative layer of dead air is contained between the panes. It is also known that when such an insulative window structure is used to separate a cold region from a warmer region there is a tendency for condensation or frost to form on the exposed surface of the pane adjacent the warm region. The frost detracts from the utility and aesthetics of the structure. This tendency results from the fact that the pane adjacent the warmer region is usually at a cooler temperature than the air in the warmer region due to radiative and conductive heat loss from the pane.

To overcome this tendency for condensation and frost to form on the pane adjacent the warmer region, it is known in the art to provide electrical heating elements to heat the pane adjacent the warmer region. The heating elements may take various forms such as resistive wire distributed over the surface of the pane, or a conductive coating uniformly distributed on the surface. The conductive coating is desirably transparent to visible radiation, and usually is disposed on the unexposed surface of the pane so that the conductive surface is protected by the pane.

Of the heat thus supplied electrically to the pane adjacent the warmer region, a large portion is radiated to the adjacent pane which in turn normally radiates to the next colder pane or to the colder region. In most applications, it is uneconomical to heat more than one pane of the multi-pane structure. It is normally equally uneconomical to heat the colder region adjacent the window structure, particularly where energy is required to remove heat from the cooler region as, for example, in refrigerators and freezers.

The use of an electrically conductive element for heating a mirror is shown in Van Laethem, et al., U.S. Pat. No. 3,790,748. The mirror coating used by Van Laethem is not an infrared reflecting light transmitting coating. Further, a layer of electrically insulating material is included between the reflecting coating and the electrically conductive coating in the various embodiments of Van Laethem, et al.

In U.S. Pat. No. 3,612,825, Chase shows the use of the grid-like or foraminous coating applied to an inner pane of a three pane oven window which reflects radiant heat back into the oven to retain the oven heat and to keep the outer pane at a cooler temperature. The Chase oven window makes use of a convection of ambient air between the outermost and the middle pane to carry heat away from the outer window into the cooler region outside the oven.

The problem addressed by the present invention is different in that windows in a refrigerator door structure typically and desirably occupy an appreciable fraction of the area of the refrigerated cabinet front. This large expanse of window must remain clear of moisture and frost so as to display the contents of the refrigerated cabinet in an aesthetically pleasing manner at all times.

It is thus normally necessary to maintain the temperature of the outer pane above the dew point temperature of the surrounding air. Generally, this requires that the outer pane be heated. This approach, although widely used, imposes an appreciable and expensive heat load on the refrigeration system because the heated outer pane radiates readily into the colder interior of the refrigerator.

Thus, a dilemma results. If the outer pane is not heated, the formation of moisture and frost seriously detract from the cabinet's utility for displaying merchandise. On the other hand, if the outer pane is heated, the heat generated renders the unit less efficient and more expensive as a refrigerator. This is the unique problem for which the present invention provides a novel solution.

SUMMARY OF THE INVENTION

The present invention provides a frost free window for a refrigerated display case which imposes a reduced heat load on the refrigeration system as compared to prior art systems.

This improvement in multi-pane window structures is made possible by the use of an infrared-reflecting coating applied to the surface of the second pane from the warmer region on the surface thereof which faces the first pane adjacent the warmer region. The infrared-reflecting coating reflects radiant energy generated on the first pane back into that pane, thereby increasing the temperature of the first pane and reducing undesirable heat transfer into the colder refrigerated regions.

The window structures of the present invention particular application to doors and windows for refrigerated enclosures, including those used to display food in supermarkets, to doors and windows in buildings and other structures, and to windows for aquariums and other underwater viewing windows.

The novel features which are believed to be characteristic of the invention, both as to organization and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
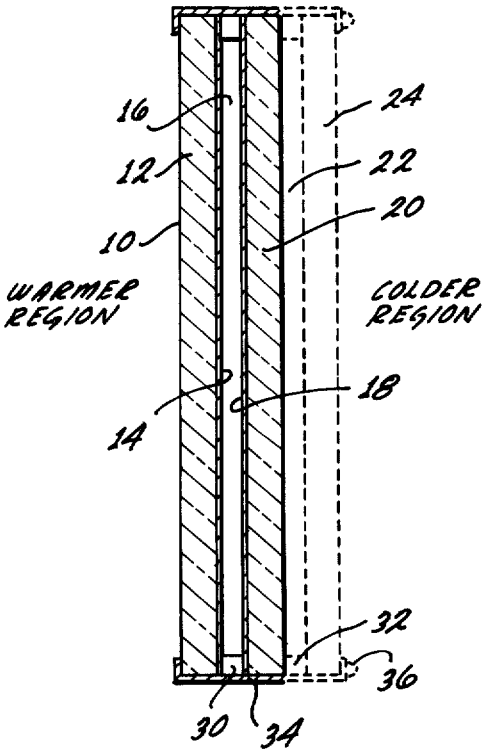
FIG. 1 is a cross-sectional view showing the window structure of the preferred embodiment.

Referring now to the drawing, there is shown in FIG. 1, a cross-section of the window structure of the preferred embodiment. The window structure is used to provide a viewing means interposed between a colder region, such as the interior of a refrigerated cabinet and a warmer region where warmer humid air is present. The window structure includes at least two panes of transparent material 12 and 20, although it may optionally include one or more additional sheets of transparent material 24, such as shown by dashed lines in FIG. 1.

Figure 2:
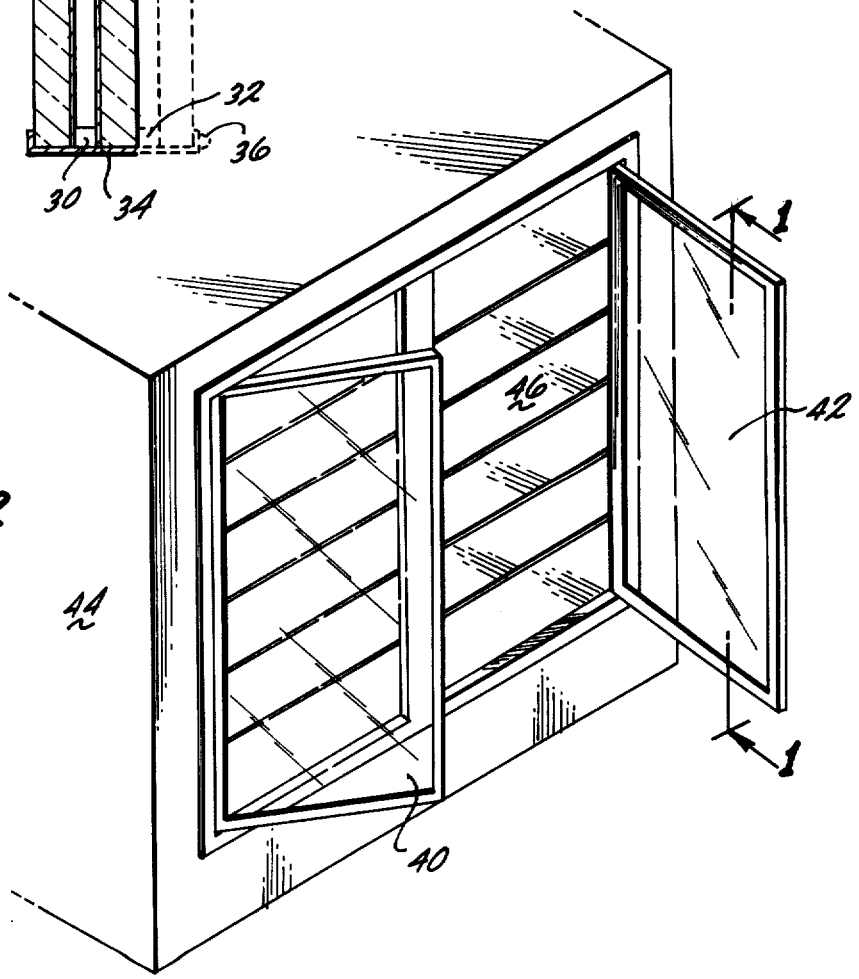
FIG. 2 illustrates a multi-pane refrigerator display door unit constructed in accordance with the principles of the present invention.

These sheets of transparent material are spaced from each other by spacers 30 and 32 to enclose spaces 16 and 22, which may be dead air spaces or which may be partially evacuated. If the panes are separated by dead air spaces, it is known in the art to fill these air spaces with dry air and to include dessicant material within the space. The structure is held together by a surrounding member 34 having a U-shaped cross-section, as is shown in U.S. Pat. No. 3,655,939 to Stromquist. In applications where the structure is used as a door, as shown in FIG. 2, member 34 is provided with a sealing means 36 such as a sealing gasket which surrounds the periphery of the door for establishing a seal with the door frame to prevent leakage of air between the inside and outside of the refrigerated cabinet, as shown in U.S. Pat. No. 3,612,821 to Stromquist.

The exposed surface of the pane adjacent the colder region is no colder than the temperature of the colder region and it may be warmer. Therefore, no condensation will form on that exposed surface. Because of the lack of moisture vapor in the dead air spaces 16 and 22, there will be little tendency for condensation to form on the surfaces defining those spaces. Therefore, the only surface on which condensation is likely to form would be the exposed surface 10 of the pane 12 adjacent the warmer humid air.

To prevent the formation of condensation or frost on that surface, it is known to heat the pane 12 so that its temperature is above the dew point temperature of the warmer air adjacent it. In a preferred embodiment, this heating is provided by a preferably clear conductive-resistive coating 14 applied to pane 12. When electricity is passed through conductive-resistive coating 14 it generates heat which is conducted into pane 12 to the exposed surface 10, thereby raising its temperature.

The heat generated at conductive coating 14 is also radiated toward the colder area including the second pane 20. In time, the temperature of pane 20 will rise because of the absorption of radiant energy and thus pane 20 will also become a radiator, radiating its excess heat into the colder area or into the additional panes 24 and 28.

Generally, it is not desirable to supply heat to the colder region. If the colder region is the interior of a refrigerated cabinet, the heat supplied must be removed again by the refrigeration system, thereby increasing the heat load on it. On the other hand, if the colder region is the outdoors on a cold day, radiating heat to it defeats the purpose of the insulative window. Therefore, the desirability can be seen of providing some means for preventing the radiant heat generated by conductive coating 14 from being transmitted into the remaining panes 20 and 24 into the colder region.

The present invention accomplishes this objective by the addition of an infrared-reflecting, visible light-transmitting coating 18 (shown in exaggerated thickness for convenience in FIG. 2) preferably applied to that surface of pane 20 which faces conductive coating 14 although it is also possible to place coating 18 on the surface of pane 20 remote from coating 14. Because of the presence of this reflective coating 18, a substantial portion of the radiant energy from conductive coating 14 is turned back and prevented from entering pane 20. The reflected radiant energy then enters pane 12 and further augments the heating provided by conductive coating 14. This increases the efficiency of coating 14 in heating pane 12. Because of this increased efficiency, the temperature of the exposed surface 10 of pane 12 can be maintained at the desired temperature with a reduced expenditure of electrical energy.

Conductive coating 14 in a preferred embodiment is a deposited coating of tin oxide having a thickness of several hundred A. The infrared-reflecting coating 18 in a preferred embodiment is a deposited coating of a metal or metallic oxide, such as tin oxide, having a high degree of infrared reflectivity and having preferably a thickness greater than 200 A. although it is to be understood that the coatings and thicknesses may be of any type having appropriate infrared reflecting, light transmitting properties. The materials used and the processes for depositing them are well known in the art. Because of the thinness of the conducting and reflecting layers and their optical properties they do not perceptably interfere with the transmission of visible light.

In other embodiments, alternative coating materials may be used for the coatings 14 and 18, and it is not necessary that the panes such as 12 and 20 comprising the window structure be parallel to each other although such will be the case in most applications.

FIG. 2 shows a multi-pane unit used as the door of a refrigerated display cabinet. In this primary application, the doors 40 and 42 generally comprise an appreciable fraction of the surface area of the refrigerated cabinet 44, to display as much of the refrigerated merchandise 46 as possible. The need for frost-free operation is obvious. Equally important is the need for an efficient and economical means of obtaining the frost-free operation. The present invention fills this need by means of a novel composite structure for the glazed surfaces.

Thus, there has been shown an insulative window structure substantially transparent to visible light having an electrically conductive coating for warming the exposed surface of the pane adjacent the warmer region to prevent condensation and frost from forming thereon, and including an infrared-reflecting visible light-transmitting coating on that surface of the second pane which faces the electrically conductive coating for increasing the heating efficiency and reducing the power consumption of the conductive coating.

The foregoing detailed description is illustrative of one preferred embodiment of the invention, and it is to be understood that additional embodiments thereof will be obvious to those skilled in the art. The embodiments described herein together with those additional embodiments are considered to be within the scope of the invention.

What is claimed is:

1. In an insulative multi-pane window structure interposable between a colder region and a warmer region to permit vision therebetween, of the type having at least a first pane having a surface exposed in use to humidity-bearing air in the warmer region and a second pane opposite and spaced apart from the first pane, and having electrical heating means on the first pane for heating the first pane by electrical resistance heating, the improvement comprising:

a substantially transparent, electrically inactive infrared reflective coating on the second pane.

2. An insulative multi-pane window structure interposable between a colder region and a warmer region, comprising:

a first window pane having outside and inside surfaces and having a transparently thin coating of electrically conductive, electrically resistant material disposed on its inside surface, said coating being adapted to generate heat upon the application of electrical potential thereacross;

a second window pane having outside and inside surfaces, said inside surface being disposed a discrete distance from and facing the inside surface of the first window pane; and transparently thin film means of electrically inactive, infrared reflective material disposed on one of said side surfaces of the second window pane, for reflecting heat generated by the electrically resistant material away from the second window pane.

3. The insulative multi-pane window structure of claim 2 wherein the window is positioned within a door.

4. The insulative multi-pane window structure of claim 2 wherein the thin film means includes reflective material disposed on the inside surface of said second window pane.

5. The insulative multi-pane window structure of claim 2 wherein the thin film means includes reflective material disposed on the outside surface of said second window pane.

6. The insulative multi-pane window structure of claim 2 further including means for selectively applying electrical potential to said electrically conductive, electrically resistant material.

7. The insulative multi-pane window structure of claim 6 wherein the first window pane is heated at least above the dew point of air to which the outside surface of the first window pane is exposed.

8. The window structure of claim 2 wherein said second pane is substantially parallel to said outer pane.

9. The window structure of claim 2 further comprising a substantially dry gas in the space between said outer pane and said second pane.

* * * * *